United States Patent [19]

Miller

[11] Patent Number: 4,499,796

[45] Date of Patent: Feb. 19, 1985

[54] FLUID PRESSURE RELEASING TOOL

[76] Inventor: Jon L. Miller, Star Rte. B, Rosseau, Minn. 56751

[21] Appl. No.: 527,249

[22] Filed: Aug. 29, 1983

[51] Int. Cl.[3] ..... B25B 7/00

[52] U.S. Cl. ..... 81/5.1 R; 137/322; 222/402.15; 222/473

[58] Field of Search ..... 81/5.1 R; 137/231, 322, 137/436, 437, 449; 222/402.15, 191, 472, 473, 474

[56] References Cited

U.S. PATENT DOCUMENTS

| | | | |
|---|---|---|---|
| 1,154,718 | 9/1915 | Neff | 81/5.1 R |
| 1,248,923 | 12/1917 | Ryczek . | |
| 1,435,150 | 11/1922 | Carpenter . | |
| 2,328,866 | 9/1943 | Van Sittert et al. . | |
| 2,342,479 | 2/1944 | Miles et al. . | |
| 2,529,599 | 11/1950 | Dick . | |
| 2,601,117 | 6/1952 | Graham . | |
| 2,755,541 | 7/1956 | Kruger . | |
| 2,868,421 | 1/1959 | Schott | 222/402.15 |
| 2,960,260 | 11/1960 | Kutik | 222/402.15 |
| 3,506,159 | 4/1970 | Muller | 222/473 |
| 4,089,440 | 5/1978 | Lee | 222/402.15 |
| 4,169,395 | 10/1979 | Hoskinson . | |

FOREIGN PATENT DOCUMENTS

| | | | |
|---|---|---|---|
| 1322222 | 2/1963 | France | 137/322 |
| 2038952 | 7/1980 | United Kingdom | 222/402.15 |

*Primary Examiner*—Roscoe V. Parker

*Attorney, Agent, or Firm*—Burd, Bartz & Gutenkauf

[57] ABSTRACT

A hand tool for opening and holding a check valve in an open position to release hydraulic fluid in a hose. One lever has a yoke with a pair of ears accommodating a portion of the hose to locate the coupling in a pocket formed by a U-shaped collar mounted on the other lever. A finger located in the pocket of the U-shaped collar engages the check valve and holds the check valve in an open position to release the pressure of the fluid in the check valve assembly and hose. The operator is shielded from the fluid flowing from the check valve by the generally U-shaped collar.

34 Claims, 12 Drawing Figures

FIG.1
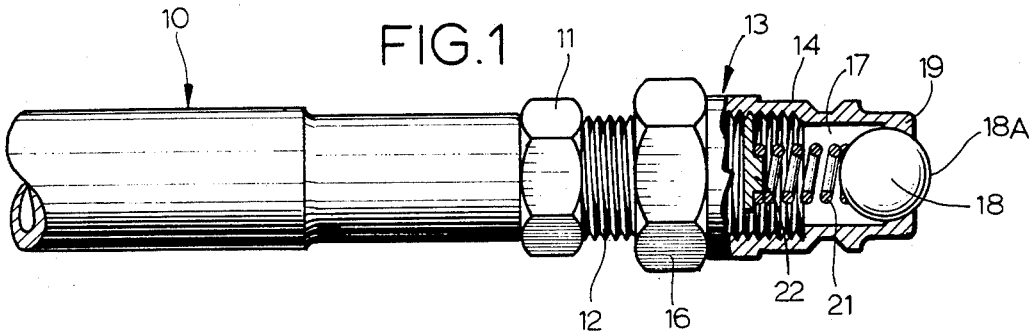
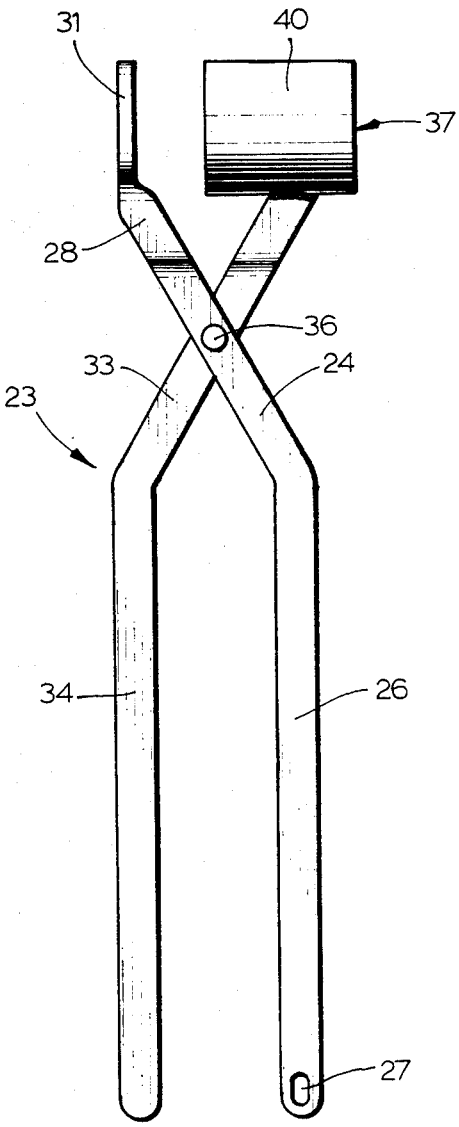
FIG. 2
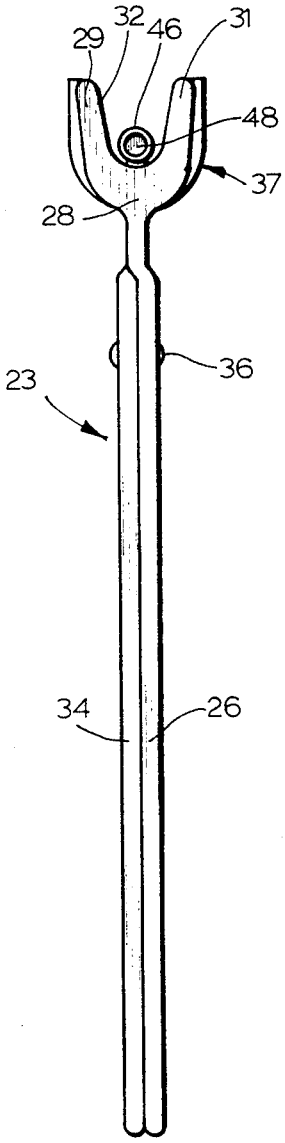
FIG. 3
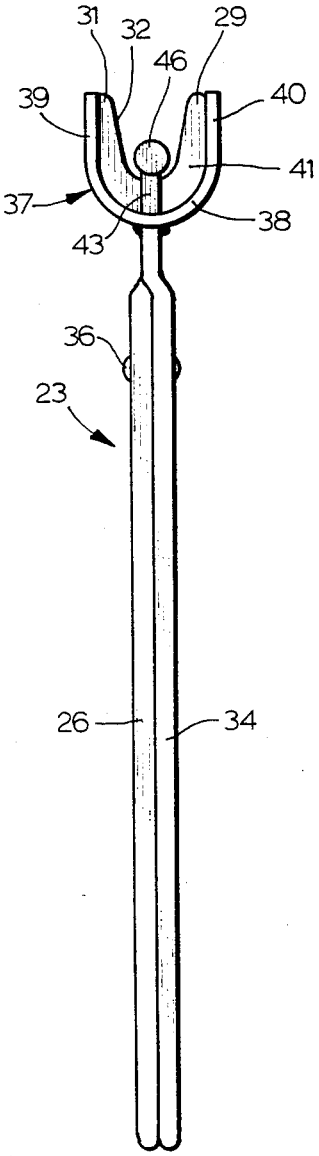
FIG. 4

FLUID PRESSURE RELEASING TOOL

TECHNICAL FIELD

The field of the invention relates to a tool to open a normally closed check valve to relieve fluid pressure in a fluid system. The tool is a manually operated lever tool operable to hold a check valve assembly and move a closed check valve to an open position to allow fluid to flow through the check valve assembly and relieve the pressure of the fluid therein.

BACKGROUND OF THE INVENTION

Fluid systems utilizing pneumatic and hydraulic fluids have lines, such as pipes and hoses, for carrying the fluid under pressure from a source of fluid pressure to a desired location, such as the fluid motor, fluid cylinder, and the like. Releasable couplers having check valves are used with the lines to provide means to disconnect sections of the fluid systems with a minimum loss of fluid. The couplers are provided with one-way or check valves to prevent drainage of the fluid from the disconnected lines and contamination of the fluid therein. The check valves maintain the fluid under pressure in the valve assemblies and lines. This fluid pressure must be relieved before the lines can be connected to the couplers. This is accomplished by moving the check valves to open positions and allowing a limited amount of fluid to escape. The check valves are moved to open positions by forcing the valves into engagement with a fixed object. The most convenient object is a tractor transmission housing, tire, or frame of the implement. The striking of the check valve against a hard rough surface to break the hydraulic pressure and move the check valve to the open position can damage the outer surface of the check valve and thereby reduce the life of the coupler, as well as the effective pressurization of the hydraulic system. The continued abuse of the check valve will permanently mar its outer surface and cause the check valve to leak hydraulic fluid when in the closed position. The escaping fluid is discharged as a spray into the environment. The spray is not controlled so that it can contaminate the fixed object and the operator.

SUMMARY OF INVENTION

The invention is directed to a hand tool for releasing fluid pressure in a means for accommodating fluid under pressure. The tool operates to open a normally closed check valve to allow fluid under pressure to flow into the atmosphere in a controlled direction. The tool minimizes contamination of the surrounding structure and operator with the fluid discharged from the check valve. The fluid can be hydraulic or pneumatic fluid. The tool has a pair of levers that are pivoted together with a pivot member. One lever has a yoke having spaced ears adapted to engage a portion of the fluid accommodating means to align the second lever with the check valve. The second lever has an end projection or finger adapted to be moved into engagement with the check valve and open the check valve. Shield means mounted on the second lever controls the direction of flow of fluid discharged from the check valve when it is moved to the open position.

The hand tool is used for releasing fluid pressure in a hose connected to a check valve assembly. The hose has an end that is attached to the check valve assembly. The check valve assembly has a body providing a passage accommodating a movable check valve for controlling the flow of fluid through the passage. The check valve is normally biased to a closed position. External force is required to move the check valve to the open position to allow fluid to flow from the check valve assembly to a desired location. The tool has first and second levers that are pivotally connected together at intermediate ends thereof. The first lever has a handle and a yoke. The yoke has ears and a pocket to accommodate the end of the hose. The yoke is engageable with the body of the check valve assembly. This locates the check valve of the check valve assembly in alignment with an end portion or finger projection on the second lever. When the yoke and projection are moved toward each other, the check valve is moved to the open position to allow the fluid under pressure in the hose and check valve assembly to discharge from the check valve assembly. In one embodiment, the tool biasing means yieldably holds the levers in an open or spread position. Shield means comprising a generally U-shaped collar having a second pocket is located adjacent the end portion or finger projection. The discharge portion of the check valve assembly containing the check valve is located in the pocket of the U-shaped collar so that the collar controls the direction of the flow of fluid discharged from the check valve assembly when the check valve is moved to the open position.

The tool can be useable with all types of agricultural, forestry, lawn maintenance, and construction equipment that have hydraulic power drive systems which utilize standard hydraulic quick release couplings. In the embodiment hereinafter described, the tool is used with a conventional hydraulic hose and check valve assembly coupling a tractor with an implement. The tool accommodates different types of check valve assemblies that are used with releasable couplers to connect the check valve assemblies to a source of hydraulic fluid under pressure. The tool is adapted to be carried with the tractor, making it readily available to the operator for relieving the pressure of the fluid in the hoses for carrying fluid under pressure from the tractor to an implement. The tool is sturdy in construction, effective in use, and economical to manufacture.

DESCRIPTION OF THE DRAWINGS

FIG. 1 is a side view of a hydraulic hose equipped with a male connector having a check valve;

FIG. 2 is a side view of a hand tool for moving the check valve of the male connector to an open position for releasing the pressure of the hydraulic fluid in the hose;

FIG. 3 is a rear elevational view of the tool of FIG. 2;

FIG. 4 is a front view of the tool of FIG. 2;

DESCRIPTION OF THE PREFERRED EMBODIMENTS

Figure 5:
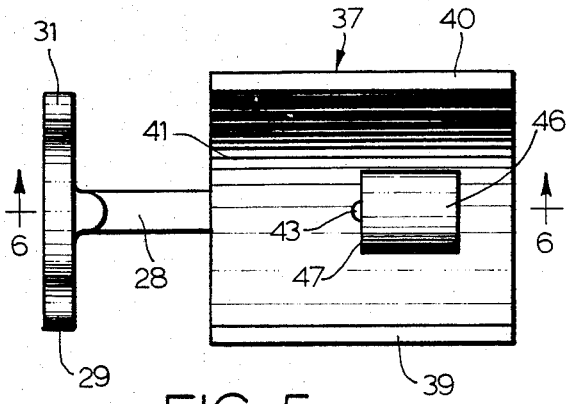
FIG. 5 is an enlarged top view of the tool of FIG. 2.
Figure 6:
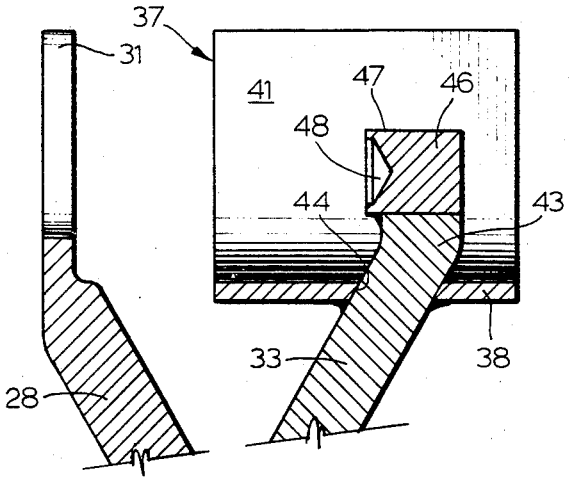
FIG. 6 is an enlarged sectional view taken along the line 6—6 of FIG. 5.

Referring to FIG. 1, there is shown a conventional hydraulic hose indicated generally at 10. Hydraulic hose 10 is of a type to connect a hydraulic cylinder to a source of hydraulic fluid under pressure. A plurality of hoses are used to connect the hydraulically operated implement to a tractor. Couplers are used to releasably connect the hose to the tractor and provide fluid communication between the source of fluid pressure carried by the tractor to the hoses. An example of a releasable coupler is shown in U.S. Pat. No. 3,710,823. Hose 10 is an example of one type of line or tubular member used to carry fluid under pressure to a desired location. A line of metal or plastic tubing or pipe can be used in lieu of hose 10. The fluid can be hydraulic or pneumatic. The following description is an example of the tool used with a hose and valve assembly for carrying hydraulic fluid, such as oil, under pressure from a tractor to an implement coupled to the tractor. The tool can be used with other fluid systems having check valves which retain fluid under pressure in the system. The hand tool is useable for releasing fluid under pressure in all types of agricultural, forestry, lawn maintenance, and construction equipment having hydraulic power drive systems which utilize the standard hydraulic quick release couplings.

Hydraulic hose 10 has an end 11 provided with external pipe threads 12. A check valve assembly or male connector indicated generally at 13 is threaded onto end 11. Connector 13 has a generally cylindrical body 14 having a longitudinal passage 17 accommodating a check valve 18. Check valve 18 is shown as a spherical member or ball. Other valve shapes can be used to close the discharge opening surrounded by annular seat 19. The fluid inlet end of body 14 has a nut 16 threaded onto end 11. The fluid outlet end of body 14 has an inwardly directed annular seat 19 providing an annular sealing surface for ball check valve 18. Seat 19 surrounds an outlet opening normally closed with check valve 18. A coil spring 21 located in passage 17 engages and biases check valve 18 into sealing relation with annular seat 19. When check valve 18 is in the closed position, an outer portion 18A thereof extends outwardly from annular seat 19. A bridge 22 in passage 17 supports one end of spring 21 and retains the spring in engagement with check valve 18.

The fluid in hose 10 is normally under pressure. Check valve 18, being biased to the closed position by spring 21, traps the fluid in hose 10 and check valve assembly 13. When check valve assembly 13 is to be attached to a coupler, the fluid pressure in the hose and check valve assembly must be released. The coupler has a central pin that holds check valve 18 open so that the fluid can flow through the check valve assembly 13 and the coupler from the source of hydraulic fluid into hose 10. Return fluid flows in the opposite direction in a separate hose. It is conventional practice to push check valve 18 against a solid object, such as the rear of a tractor tire, tractor transmission housing, or draw bar to relieve the pressure of the fluid in the coupler so that check valve 18 can be moved to the open position. The escaping hydraulic fluid is discharged into the atmosphere and collects on the tractor and the operator, as well as the implement.

The hand tool indicated generally at 23 in FIGS. 2–4 is used to release check valve 18 in a manner so that the fluid under pressure will be directed into a desired location, thereby preventing the contamination of the tractor, implement, and operator. Tool 23 has a first lever 24 pivotally connected to a second lever 33 with a pivot pin 36. Lever 24 has an elongated linear handle 26 provided with a hole 27 in the outer end thereof. Hole 27 can accommodate a cord or chain to connect the tool to the tractor or implement. The inner end of lever 24 has a bifurcated yoke 28. Yoke 28 is a generally U-shaped structure having a pair of forwardly directed ears 29 and 31. A generally U-shaped first pocket or recess 32 is located between ears 29 and 31.

Second lever 33 has a linear handle 34 laterally spaced from handle 26 and extended generally parallel thereto. The inner end of lever 33 has a generally U-shaped collar 37. As shown in FIG. 4, collar 37 has a concave-curved base 38 and upwardly directed side members 39 and 40. Collar 37 has a generally U-shaped second pocket or recess 41 located between side members 39 and 40. The pocket 41 is deeper and wider than pocket 38 between ears 29 and 31. Pockets 38 and 41 are longitudinally aligned with each other and have a common central axis that is perpendicular to the axis of pivot pin 36.

Figure 8:
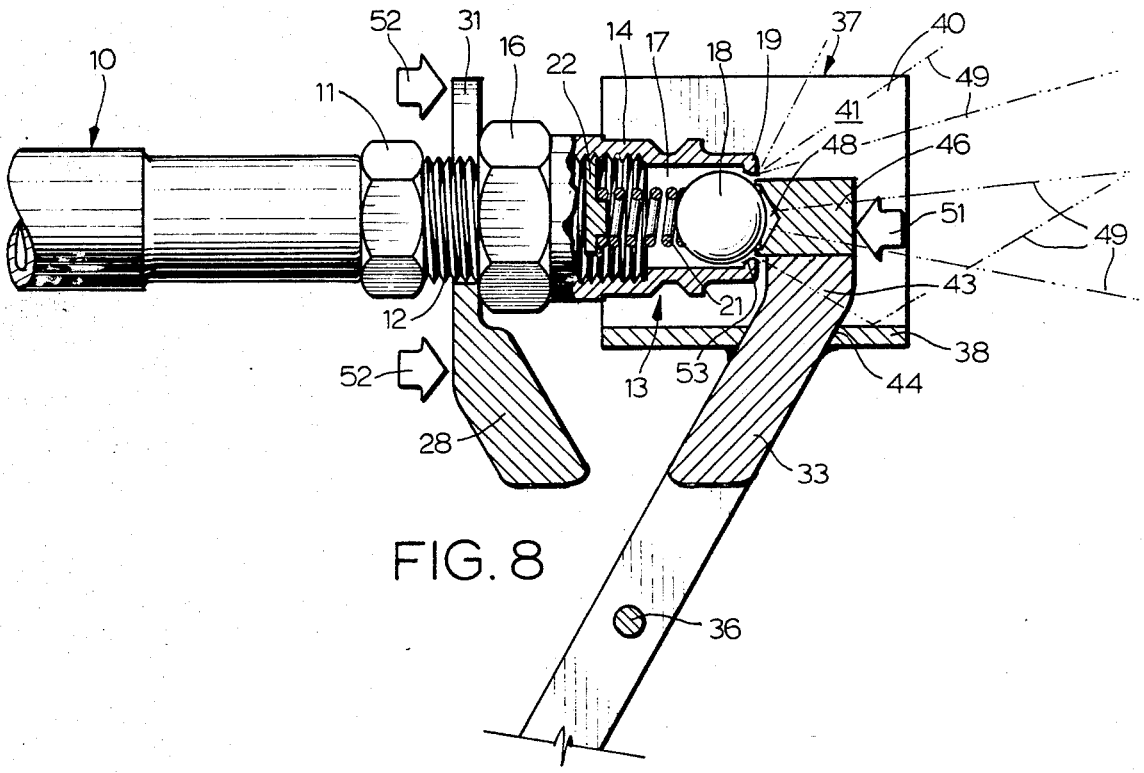
FIG. 8 is a longitudinal sectional view of the tool in assembled relation with a male connector attached to a hydraulic fluid hose showing the check valve in the release position.
Figure 12:
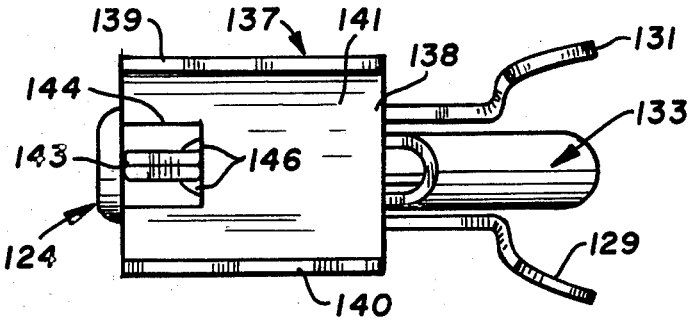
FIG. 12 is a top plan view of FIG. 9.

Lever 33 has an outwardly directed end or finger 43 extended through base 38. As shown in FIG. 8, base 38 has a hole 44 accommodating end 43. Welds or the like secure end 43 to base 38. A cylindrical tip or projection 46 is secured to end 43. Projection 46 has an end section 47 facing yoke 28, provided with a generally cone-shaped recess 48. The projection is the end of finger 43 and comprises a check valve engaging means. End section 47 has a dimension that is smaller than the fluid discharge opening formed by annular seat 19 in check valve assembly 13 so that projection 46 can be moved through the discharge opening and engage and hold check valve 18 open. Recess 48 extends along a longitudinal axis that passes centrally through pockets 32 and 41.

Figure 7:
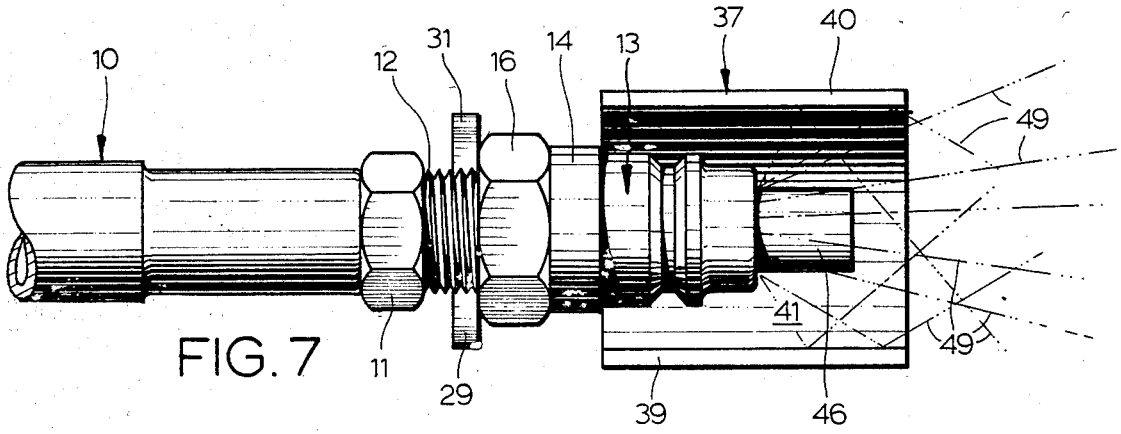
FIG. 7 is a top view of the tool in assembled relation with a male connector attached to a hydraulic fluid hose.

In use, as shown in FIGS. 7 and 8, ears 29 and 31 are located adjacent opposite sides of the threaded portion of end 11 of the hose. Ears 29 and 31 engage nut 16 of check valve assembly 13 threaded onto end 11. This locates end 11 in first pocket 32. Body 14 and the discharge end thereof accommodating check valve 18 is located in the center portion of second pocket 41 between side walls 39 and 40. Tip 46 is aligned with check valve 18. The outer portion 18A of check valve 18 fits into recess 48 to center tip 46 on check valve 18. When handles 26 and 34 are moved toward each other, yoke 28 is moved in the direction of arrows 52. Projection 46 is moved in the direction of the arrow 51 thereby forcing check valve 18 against spring 21 and opening check valve assembly 13. When check valve assembly 13 is opened, an annular passage 53 is provided between the outer surface of check valve 18 and the seat of the annular member 19. This allows the fluid under pressure to escape from hose 10 and check valve assembly 13. The broken lines 49 illustrate the fluid being discharged through passage 53. The base 38 and side walls 39 and 40 function as shields and direct the fluid in a forward direction away from the operator into a container or another desired location.

When the pressure of the fluid has been released, tool 23 is removed from check valve assembly 13. The squeezing force on handles 26 and 34 is released. This allows yoke 28 to be slipped from hose end 11 and tip 46 to be removed from check valve 18. Spring 21 biases check valve 18 to its closed position to prevent loss of fluid and the contamination of the fluid in hose 10 and check valve assembly 13.

Referring to FIGS. 9–12, there is shown a modification of the hand tool indicated generally at 123 used to apply a smooth and uniform force on the check valve, such as a ball, of a male connector to allow pressurized fluid to escape without damage to the check valve. The discharging fluid is directed to a desired location, such as a container for reuse, thereby preventing contamination of the equipment, operator, and surrounding environment.

Hand tool 123 has a first lever 124 pivotally connected to a second lever 133 with a common pivot pin 136. Lever 124 has an elongated handle 126 having a generally U-shaped cross section. Opposite sides of the handle adjacent pivot pin 136 form an upwardly directed yoke 128 for accommodating a portion of the hose and check valve assembly mounted thereon. Yoke 128 has a pair of upwardly and outwardly diverging ears 129 and 131. The ears 129 and 131 are laterally spaced from each other and form a pocket or recess 132 for accommodating the threaded portion 12 of hose 10. Ears 129 and 131 have outwardly diverging inner edges adapted to engage nut 16 and thereby longitudinally and axially locate the hose and check valve assembly 13 in operative relation with hand tool 123.

Second lever 133 has an elongated handle 134 having a generally U-shaped cross section. Handle 134 has an upper portion supporting a generally U-shaped collar 137. Collar 137 has a concave curved base 138 and upwardly directed side members 139 and 140. The base 138 and side members 139 and 140 define a U-shaped second pocket or recess 141. Recess 141 is longitudinally aligned with pocket 132 formed by the yoke 128. Pocket 132 and recess 141 have a common central or longitudinal axis that is perpendicular to the axis of pivot pin 136.

Second lever 133 has an upwardly directed end 143 extended through a hole 144 in base 138 of collar 137. End 143 is a projection or finger comprised of side-by-side flat portions of the sides of upper end of lever 143. The inner edge of end 143 has outwardly directed curved enlarged portions 146 providing a generally semi-hemispherical shaped recess 148 to accommodate a portion of the check valve 18. Recess 148 extends generally along a longitudinal axis that passes centrally through the pocket 132 and recess 141.

Figure 10:
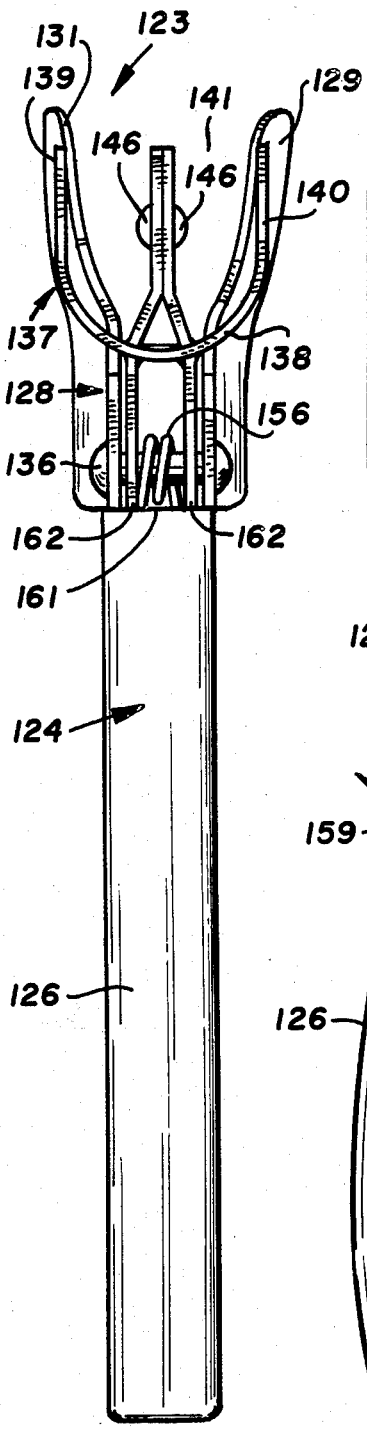
FIG. 10 is a left side view of FIG. 9.
Figure 9:
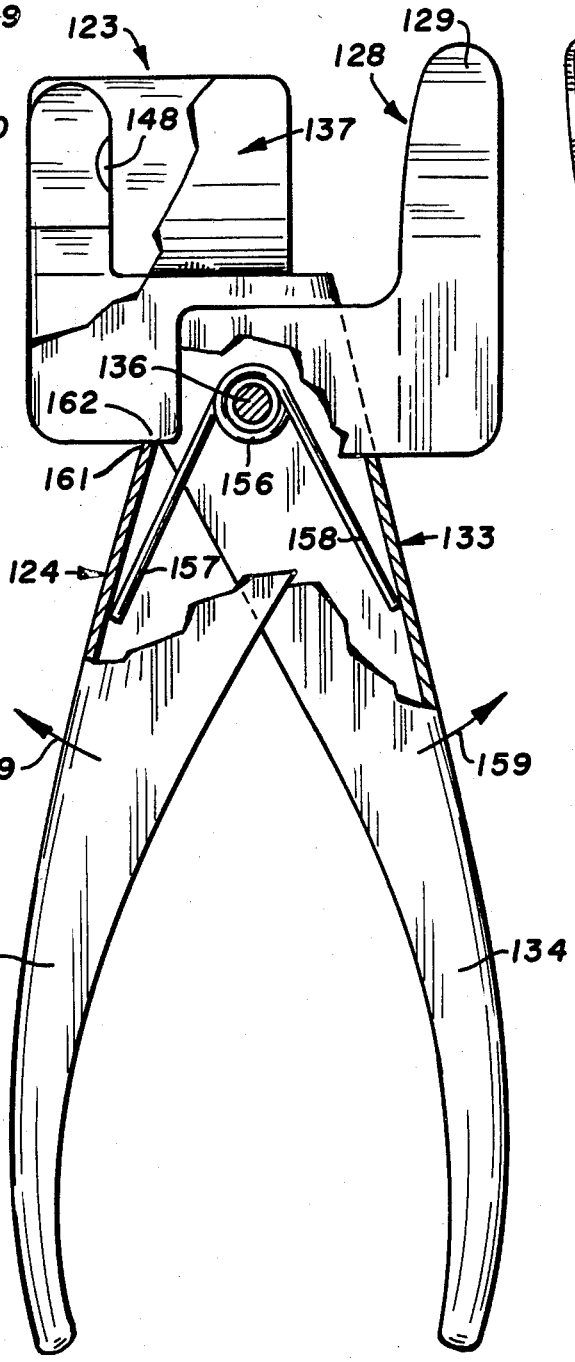
FIG. 9 is a side elevational view, partly sectioned, of a modification of a hand tool for moving a check valve of a male connector to an open position for releasing the pressure of hydraulic fluid in a hose.
Figure 11:
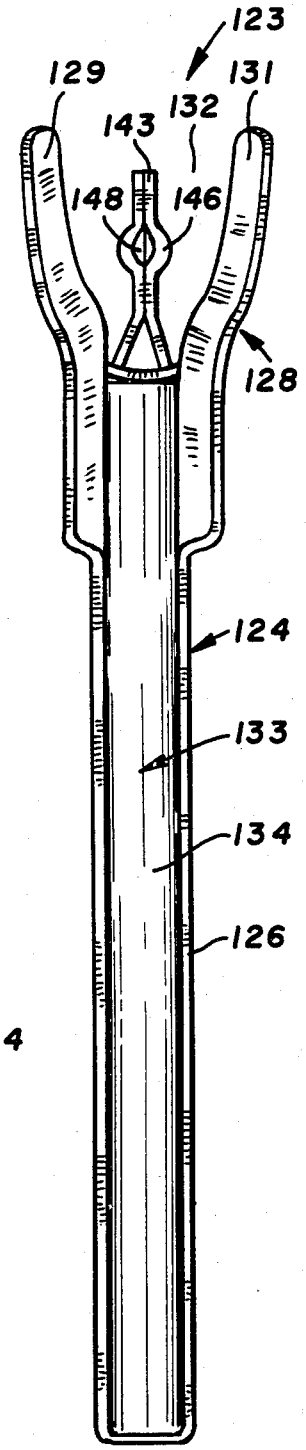
FIG. 11 is a right side view of FIG. 9.

As shown in FIGS. 9 and 10, a torsion coil spring 156 is located about the mid-portion of pivot pin 136. Coil spring 156 has a first end 156 located in engagement with first lever 124 and a second end 158 located in engagement with second lever 133. Spring 156, in conjunction with its ends 156 and 158, exerts an outwardly directed biasing force on the levers 124 and 133, as indicated by the arrows 159. Spring 156 pivots and yieldably holds the levers 124 and 133 to their open or spread position. The open position is determined by a stop edge 161 on the upper end of lever 133 and shoulders 162 on the upper end of lever 124. The U-shaped collar 137 is secured by welds or the like to the top of shoulders 162.

In use, ears 129 and 131 are located adjacent opposite sides of the threaded portion of end 11 of the hose. The ears 129 and 131 engage nut 16 of check valve assembly 13. This locates end 11 in the first pocket 132. Body 14 and the fluid discharge end thereof accommodating check valve 18 is located in the center portion of the second pocket or recess 141 between the side walls 139 and 140 of the U-shaped collar 137. The end or finger is longitudinally aligned with the check valve 18. The outer portion 18A of the check valve is aligned with and fits into recess 148 to center the end 143 on check valve 18. When handles 126 and 134 are moved toward each other against the biasing force of spring 156, end 143 forces check valve 18 to the open position. This allows any fluid under pressure within the check valve assembly 13 to escape, thereby releasing the pressure of the fluid in hose 10 and check valve assembly 13. The U-shaped collar 137 provides shielding walls for the spray of fluid being discharged from the check valve assembly. The operator can direct the fluid into a container for reuse or to a desired location. This prevents loss of fluid and the contamination of the equipment, operator, and environment.

While there have been shown and described two embodiments of the hand tool for moving a check valve to an open position to reduce fluid under pressure in a hose and check valve assembly, it is understood that the changes in the structure, arrangement of structure, and check valve assembly and check valve can be made by those skilled in the art without departing from the invention. The invention is defined in the following claims.

The embodiments in which an exclusive property or privilege are claimed are defined as follows:

1. A tool for releasing fluid pressure in a means for accommodating fluid under pressure, said means having a normally closed check valve, said check valve being movable to an open position to allow fluid under pressure to flow from said means thereby reducing the fluid pressure therein, comprising: first lever means having a yoke adapted to engage a portion of the means for accommodating fluid under pressure, second lever means having a projection adapted to engage the check valve, pivot means connecting the first and second lever means to allow the yoke and projection to selectively have relative movement toward and away from each other, said yoke and projection, when moved toward each other, causes the check valve to move to the open position thereby allowing the fluid under pressure in the means accommodating fluid under pressure to flow therefrom, and shield means mounted on the second lever means adjacent the projection for controlling the direction of flow of fluid discharged from the means accommodating fluid under pressure when the check valve is moved to the open position.

2. The tool of claim 1 wherein: the yoke is a generally U-shaped end section of the first lever means.

3. The tool of claim 2 wherein: the yoke has a pair of laterally spaced ears providing a pocket.

4. The tool of claim 3 wherein: said ears have outwardly diverging inside portions.

5. The tool of claim 1 wherein: said projection has a recess for accommodating a portion of said check valve.

6. The tool of claim 1 wherein: said shield means is an elongated generally U-shaped collar having a pocket, said projection being located in said pocket whereby, when the check valve is moved to the open position, the fluid flow is controlled by the U-shaped collar.

7. The tool of claim 6 wherein: said collar has laterally spaced elongated side walls joined to a bottom wall, said second lever means being secured to said bottom wall.

8. The tool of claim 7 wherein: said second lever means has an end section projected through said bottom wall, said projection being secured to said end section.

9. The tool of claim 8 wherein: said projection is located above the bottom wall and between the side walls.

10. The tool of claim 9 wherein: said projection has a recess for accommodating a portion of the check valve.

11. The tool of claim 1 wherein: said yoke is a generally U-shaped end section of the first lever means having a first pocket, said shield means being a generally U-shaped collar having a second pocket, said yoke locating the check valve in said second pocket whereby, when the check valve is moved to the open position, the collar controls the direction of flow of fluid discharged from the means accommodating fluid under pressure.

12. The tool of claim 11 wherein: said yoke has a pair of laterally spaced ears, said ears having outwardly diverging inside portions providing said first pocket.

13. The tool of claim 11 wherein: said projection has a recess for accommodating a portion of the check valve.

14. The tool of claim 11 wherein: said collar is an elongated U-shaped trough member having an open top and open ends.

15. The tool of claim 1 wherein: the yoke has a pair of laterally spaced ears adapted to engage the portion of the means for accommodating fluid under pressure.

16. The tool of claim 1 including: biasing means for biasing the first and second lever means in a direction to move the yoke and projection away from each other.

17. The tool of claim 15 wherein: the biasing means includes a coil spring located about the pivot means and engageable with the first and second lever means.

18. A tool for releasing fluid pressure in a means for accommodating fluid under pressure, said means having a normally closed check valve, said check valve being movable to an open position to allow fluid under pressure to flow from said means thereby reducing the fluid pressure therein, comprising: first lever means having ear means adapted to engage a portion of the means for accommodating fluid under pressure, second lever means having check valve engaging means adapted to engage the check valve, pivot means connecting the first and second lever means to allow the ear means and check valve engaging means to selectively have relative movement toward and away from each other, said ear means and check valve engaging means, when moved toward each other, causes the check valve to move to the open position thereby allowing the fluid under pressure in the means accommodating fluid under pressure to flow therefrom, and shield means mounted on the second lever means adjacent the check valve engaging means for controlling the direction of flow of fluid discharged from the means accommodating fluid under pressure when the check valve is moved to the open position.

19. The tool of claim 18 wherein: the ear means comprise a pair of laterally spaced ears providing a pocket for accommodating said portion of the means for accommodating fluid under pressure.

20. The tool of claim 18 wherein: said check valve engaging means has a recess for accommodating a portion of said check valve.

21. The tool of claim 18 wherein: said check valve engaging means includes an end portion of the second lever means, said end portion having a recess for accommodating a portion of said check valve.

22. The tool of claim 18 wherein: said shield means is an elongated generally U-shaped collar having a pocket, said check valve engaging means being located in said pocket whereby, when the check valve is moved to the open position, the direction of the fluid flow is controlled by the U-shaped collar.

23. The tool of claim 22 wherein: said collar has laterally spaced elongated side walls joined to a bottom wall, said second lever means being secured to said bottom wall.

24. The tool of claim 18 including: biasing means for biasing the first and second levers in a direction to move the ear means and check valve engaging means away from each other.

25. The tool of claim 24 wherein: the biasing means includes a coil spring located about the pivot means and engageable with the first and second lever means.

26. A tool for releasing fluid pressure in a hose and check valve assembly connected to the hose, said hose having an end attached to the check valve assembly, said check valve assembly including a body having a passage and a check valve for controlling the flow of fluid in the passage, said body having a fluid discharge end containing the check valve, said check valve normally located in a closed position to allow fluid to flow from the check valve assembly thereby reducing the pressure of the fluid in the hose and check valve assembly, comprising: first lever means having a handle and ear means, said ear means providing a first pocket to accommodate the end of the hose, said ear means being engageable with the body when said end is located in said first pocket, second lever means having a handle and check valve engaging means adapted to engage the check valve when said end is located in the first pocket, pivot means connecting the first and second lever means to allow the ear means and check valve engaging means to selectively have relative movement toward and away from each other, said handles being manually moved to provide said relative movement of the ear means and check valve engaging means, said ear means and check valve engaging means, when moved toward each other, causes the check valve to move to the open position thereby allowing the fluid under pressure in the hose and check valve assembly to flow from the check valve assembly, and shield means mounted on the second lever means adjacent the check valve engaging means and comprising a generally U-shaped collar having a second pocket, said ear means locating the discharge end of the body and check valve therein in said second pocket whereby the collar controls the direction of flow of fluid discharged from the check valve assembly when the check valve is moved to the open position.

27. The tool of claim 26 wherein: said ear means include a pair of laterally spaced ears providing said first pocket.

28. The tool of claim 26 wherein: said check valve engaging means has a recess for accommodating a portion of said check valve.

29. The tool of claim 26 wherein: said collar has laterally spaced elongated side walls joined to a bottom wall, said second lever means being secured to said bottom wall.

30. The tool of claim 26 wherein: said collar is an elongated U-shaped trough member having an open top and open ends.

31. The tool of claim 26 wherein: said check valve engaging means includes an end portion of the second lever means, said end portion having a recess for accommodating a portion of said check valve.

32. The tool of claim 26 wherein: said collar has laterally spaced elongated side walls joined to a bottom wall, said check valve engaging means includes an end portion extended through said bottom wall and located between said elongated side walls.

33. The tool of claim 26 including: biasing means for biasing the first and second lever means in a direction to move the ear means and check valve engaging means away from each other.

34. The tool of claim 33 wherein: the biasing means includes a coil spring located about the pivot means and engageable with the first and second lever means.

* * * * *